United States Patent [19]

Winter et al.

[11] 4,433,761

[45] Feb. 28, 1984

[54] PORTFOLIO WITH FRAME AND INTEGRAL ARTICLE RETAINERS

[75] Inventors: Roger D. Winter, Lakewood; David E. Workman, Evergreen; Mark B. Nordstrom, Denver, all of Colo.

[73] Assignee: Samsonite Corporation, Denver, Colo.

[21] Appl. No.: 343,252

[22] Filed: Jan. 27, 1982

[51] Int. Cl.[3] ..... A45C 3/02; A45C 13/04

[52] U.S. Cl. ..... 190/109; 150/52 B; 29/469

[58] Field of Search ..... 150/1.6, 52 B, 30; 190/51, 109; 206/425; 29/469

[56] References Cited

U.S. PATENT DOCUMENTS

| | | | |
|---|---|---|---|
| 398,669 | 2/1889 | Starkey . | |
| 504,840 | 9/1893 | Krick . | |
| 1,702,279 | 2/1929 | Slomka . | |
| 1,742,821 | 1/1930 | Nichols . | |
| 2,181,587 | 11/1939 | Plotkin . | |
| 2,316,328 | 4/1943 | Guenther et al. | 150/1.6 |
| 2,331,802 | 10/1943 | Rosenkrantz | 150/30 |
| 2,669,273 | 2/1954 | Keirsey . | |
| 2,846,800 | 8/1958 | Marks et al. | 190/51 X |
| 3,082,049 | 3/1963 | Lifton . | |
| 3,123,190 | 3/1964 | Lifton . | |
| 3,126,891 | 3/1964 | Caputi . | |
| 3,137,374 | 6/1964 | Holtzman . | |
| 3,199,643 | 8/1965 | Korchmar . | |
| 3,298,479 | 1/1967 | Palmer et al. . | |
| 3,698,522 | 10/1972 | Aronoff | 190/51 X |
| 3,861,556 | 1/1975 | Barecki et al. | 150/1.6 X |
| 3,874,501 | 4/1975 | Cronheim | 206/425 |
| 4,088,252 | 5/1978 | Grunberger | 150/1.6 X |
| 4,121,637 | 10/1978 | Jennings | 150/1.6 |
| 4,294,558 | 10/1981 | Errichiello | 150/1.6 X |

FOREIGN PATENT DOCUMENTS

| | | | |
|---|---|---|---|
| 862439 | 1/1953 | Fed. Rep. of Germany | 383/38 |
| 427215 | 4/1935 | United Kingdom | 150/1.6 |
| 2007193 | 5/1979 | United Kingdom | 190/51 |

*Primary Examiner*—William Price
*Assistant Examiner*—Sue A. Weaver
*Attorney, Agent, or Firm*—Crandell & Polumbus

[57] ABSTRACT

A portfolio for an attache case or the like includes a front panel assembly defined by a portfolio frame and a backing panel. The portfolio frame is preferably formed from a single piece of molded material, such as plastic, having flexible but semirigid characteristics. A peripheral margin structure of the portfolio frame defines an interior opening through the frame, and the backing panel covers the interior opening. Article retention means extend from the peripheral margin structure into the interior opening. The article retention means cooperate with the backing panel to retain articles therebetween. The backing panel is attached to the portfolio frame preferably by ultrasonically deforming projections from the frame over openings in the panel. A pocket structure of the portfolio is preferably sewn to rearward extending skirt portions of the peripheral margin structure of the frame.

31 Claims, 11 Drawing Figures

PORTFOLIO WITH FRAME AND INTEGRAL ARTICLE RETAINERS

This invention pertains to portfolios, particularly those for use with attache cases, luggage cases and the like. More specifically, the invention pertains to a portfolio having a front frame structure formed of semirigid and resilient material and including at least one article retainer means which is integrally a part of the frame. The invention further pertains to manufacturing the portfolio.

Portfolios are preferred for use in attache cases and the like because numerous file pockets are provided for conveniently holding, separating and sorting numerous articles such as pencils, pens, envelopes, business cards and papers, among other things. The typical portfolio includes a plurality of individual file pockets connected together in an accordion-like fashion. The material defining the accordion-like assembly of file pockets is generally flexible to allow each of the pockets to pivot out from the interior of the top half or portion of the attache case and to attain sufficient flexibility to pivot closed when items are retained in the file pockets or when larger, more bulky items in the bottom half or portion of the case press against the portfolio.

The typical portfolio is usually constructed by sewing the front face panel, gussets and the file pocket dividers. The front face panel requires particular attention during construction. The front face panel is typically covered with fabric material which matches the fabric material within the interior of the attache case. Furthermore, small article retaining pockets are usually sewn or otherwise attached to the front face panel, for the purpose of containing in an accessible location, very small items such as business cards, pencils, envelopes and the like. The small article retaining pockets sometimes require elastic, snaps, or other types of fasteners to hold the pockets closed. These requirements and constraints substantially increase the amount of time and expense required for sewing and fabricating the portfolio, particularly with respect to the front panel assembly of the portfolio.

INVENTION SUMMARY

One of the objectives of the present invention is to reduce the amount of time and materials required to fabricate a portfolio for an attache case, and consequently reduce the cost of constructing the portfolio. Another objective is to provide a new and improved portfolio having a front panel assembly defined in substantial part by a semirigid frame of structural material, such as molded plastic, to thereby reduce the time and materials required to construct the front panel assembly of the portfolio. Another objective is to provide new and improved article retaining means as a part of the frame of the front panel assembly of the portfolio. Another significant objective is to teach a new and improved method of manufacturing a portfolio utilizing a frame in the front panel assembly of the portfolio.

Generally summarized, the aspects of the present invention which implement these and other objectives include a portfolio frame preferably formed and molded from a single piece of integral plastic material. The portfolio frame includes a peripheral margin structure defining an open interior or center area extending through the frame. A backing panel is attached to the rear of the portfolio frame and extends across the open center area. Article retention means, preferably in the form of a cantileverly connected clip and a pair of L-shaped corner brackets, extend from the peripheral margin structure inward into the open center area and lie against the backing panel. The resiliency of the article retention clip and brackets retains articles between the retention clips and brackets and the backing panel. The clip is preferably formed with undulating grooves and elongated articles such as pens, pencils, or the like, can be retained in the grooves. The peripheral margin structure of the portfolio frame includes rearward extending skirt-like border portions to which gussets of a pocket structure can be attached. The backing panel is preferably attached to the portfolio frame by ultrasonically welding or deforming attachment projections of the frame to retain the backing panel. The portfolio frame can be quickly and inexpensively formed by injection molding, for example, and the backing panel is quickly attached to the frame. The time required for assembling numerous different materials into the front panel assembly of the portfolio, and the cost of these materials, are substantially reduced. The article retaining clips and brackets provide a new and improved means for retaining very small articles in a more accessible location than if these articles were in the small pockets of the typical front panel assembly of a previous portfolio.

Many other improvements and advantages are apparent from the following detailed description of a preferred embodiment, taken in conjunction with the accompanying drawings.

DRAWING DESCRIPTION

PREFERRED EMBODIMENT

Figure 1:
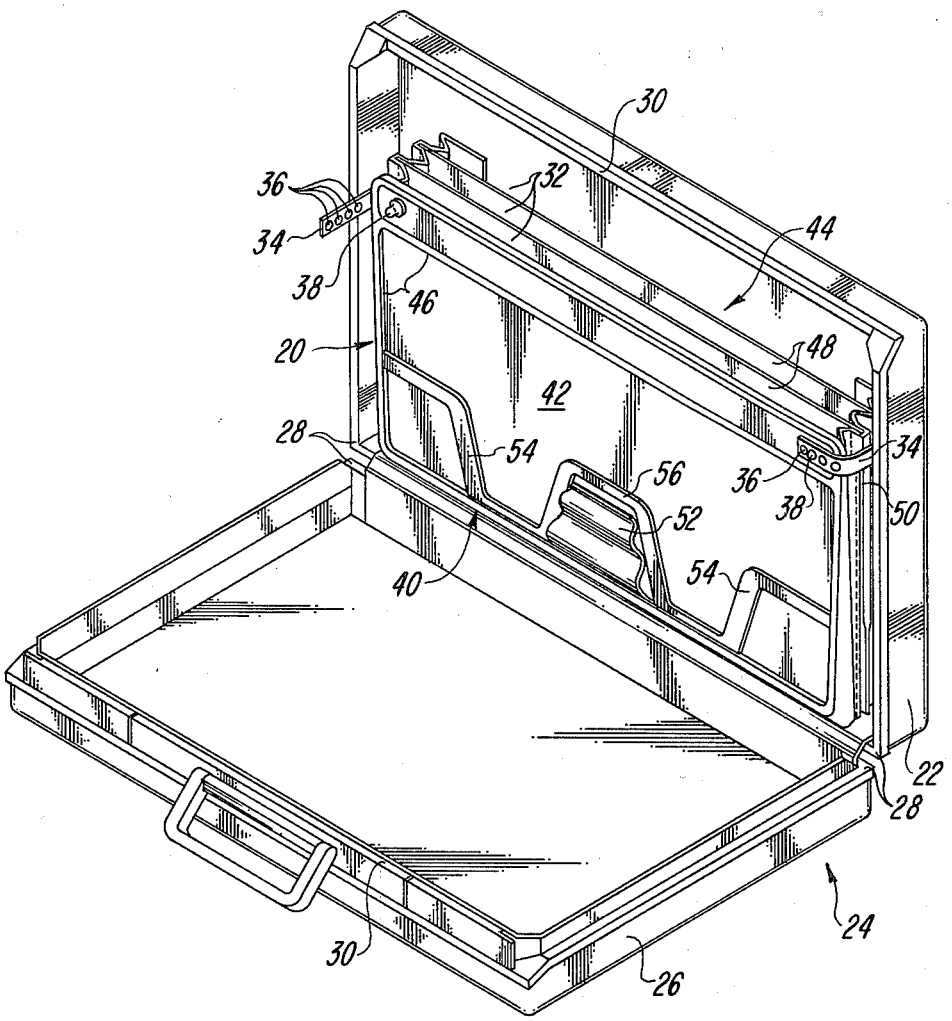
FIG. 1 is a perspective view of an open attache case with the portfolio of the present invention attached within the interior of the upper half or portion of the case.

A presently preferred embodiment of the portfolio 20 of the present invention is introduced by reference to FIG. 1. The portfolio 20 is operatively retained within the interior of an upper case portion or half 22 of a luggage or attache case 24, or the like. The attache case 24 also includes a lower case portion or half 26. The case halves 22 and 26 are pivotably connected in the conventional clamshell-like manner along back edges 28 of both case halves. A conventional latching mechanism (not specificlly shown) is provided for holding both case halves 22 and 26 in the closed position. The cooperative elements of the latching mechanism are attached to and carried by front edges 30 of the case halves 22 and 26. Other details of the case 24 itself are conventional.

The portfolio 20 operatively pivots outward from the inteior of the upper case half 22. The lower or bottom margin of the portfolio 20 is connected within the interior of the upper case half at a position adjoining the back edge 28 of the upper case half 22. The upper or top margin of the portfolio 20 terminates short of the front edge 30 of the upper case half 22 thereby allowing additional space for access to file pockets 32 of the portfolio 20. The portfolio pivots or swings outward in an accordion-like manner from the interior of the upper case half 22 to provide further access to the file pockets 32. To selectively retain the portfolio in a collapsed condition within the interior of the upper case half 22, and thereby prevent the full extent of outward pivotable movement, fastener means such as a pair of attachment straps 34 are provided. The attachment straps 34 are connected to and extend outward from the interior of the upper case half 22. Holes 36 in each strap 34 fit over studs 38 or other fastener means of the portfolio 20 to hold the upper margin of the portfolio inward within the interior of the upper case half 22.

Figure 2:
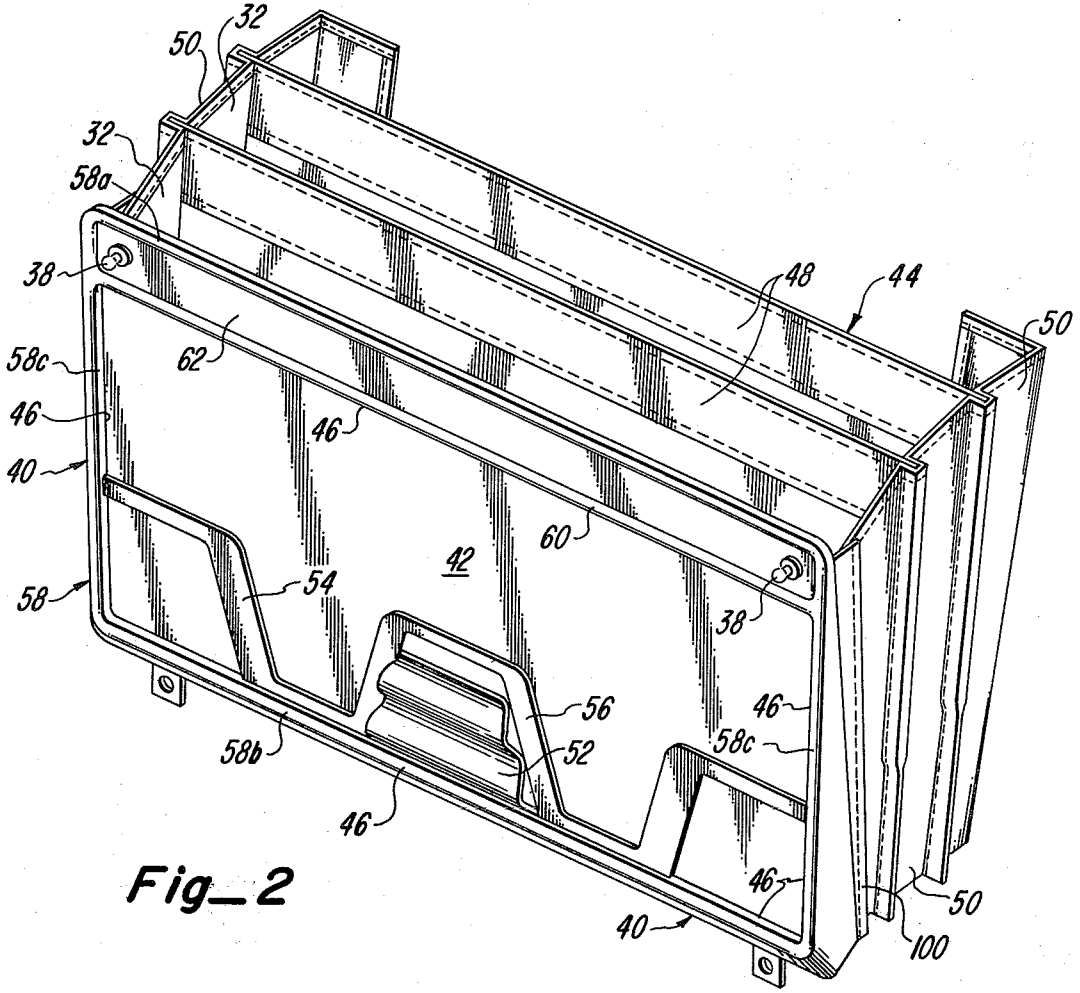
FIG. 2 is a perspective view of the portfolio shown in FIG. 1 in an accordion-like expanded condition.
Figure 3:
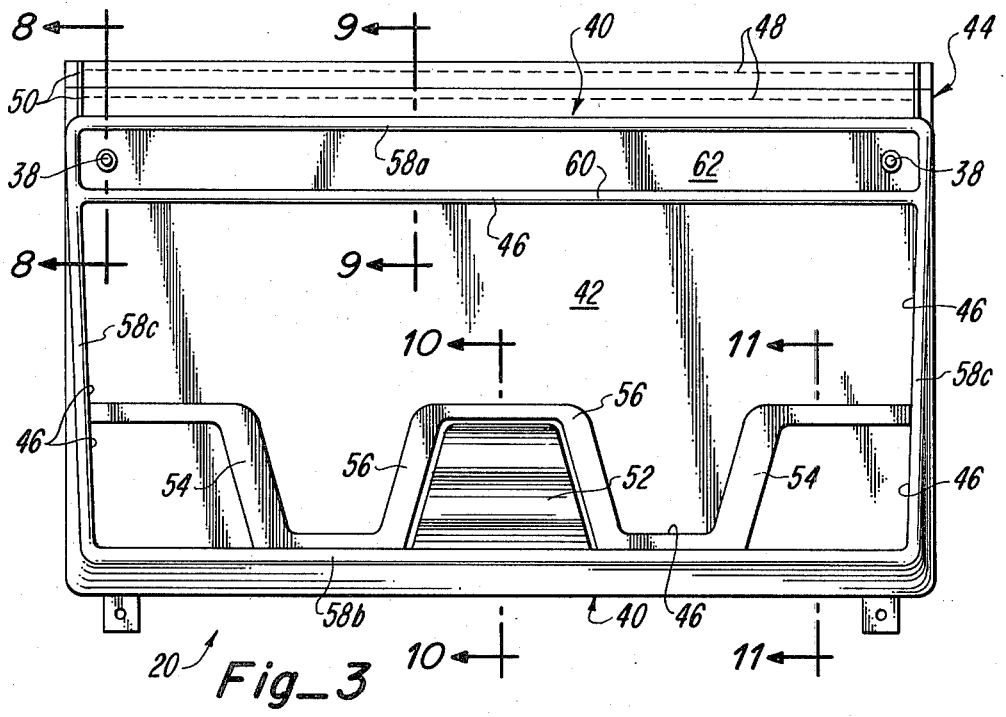
FIG. 3 is a front elevational view of the portfolio shown in FIG. 2.

The portfolio 20 is shown in FIGS. 1, 2 and 3 to comprise a front portfolio frame 40, a front backing panel 42 connected to the frame 40, and a portfolio file pocket structure 44 connected to and extending rearwardly from the frame 40. The portfolio frame 40 is preferably a single integral structural member formed of semirigid injection molded plastic material such as polypropylene. The material from which the portfolio frame 40 is formed should possess sufficient strength for adequate structural definition and support for the backing panel 42 and pocket structure 44, and should offer some flexibility to avoid breaking under normal deformation occurring as a result of retaining articles in the file pockets 32 and contacting articles within the interior of the closed attache case. The peripheral margin structure of the frame 40 defines a substantial open interior area or center opening 46 over which the backing panel 42 extends. The backing panel 42 is permanently connected to the back of the portfolio frame 40. The backing panel is formed from flexible and semirigid structural material, such as a laminated paper board, to avoid breakage when contacting articles in the interior of the case or in the file pockets. Prior to connecting the panel 42 to the frame 40, the panel 42 may be covered with cloth-like material of pleasing appearance, or alternatively, the panel may itself possess a pleasing visual characteristic. The pocket structure 44 is defined by a plurality of dividers 48 to which side gussets 50 are sewn along the horizontlly opposite and vertically extending edges of the dividers 48. The material forming the side gussets 50 is very flexible and allows the dividers 48 to collapse against one another and the backing panel 42 in an accordion-like manner. The forward edge of each side gusset 50 is attached to the portfolio frame 40, and the rearward edge of each side gusset 50 is attached to the interior of the upper case half 22 (FIG. 1). When the portfolio 20 pivots outward from the interior of the upper case half of the attache case, the portfolio pockets 32 are defined between the backing panel 42 and the adjoining divider 48, between adjoining dividers 48 and between the interior of the upper case half 22 and its adjoining divider 48 (FIG. 1).

An integral part of the portfolio frame 40 is means for retaining articles, such as business cards, envelopes pens, and the like, to the portfolio. The article retention means preferably takes the form of a clip 52 extending from the lower center portion of the peripheral margin structure of the portfolio frame 40 into the center opening 46, and/or one or more L-shaped corner brackets 54 which also extend from the peripheral margin structure of the portfolio frame 40 into the center opening 46. A U-shaped border 56 also extends from the peripheral margin structure into the open area 46 and surrounds, but does not contact, the edges of the clip 52 in the open area 46.

Figure 5:
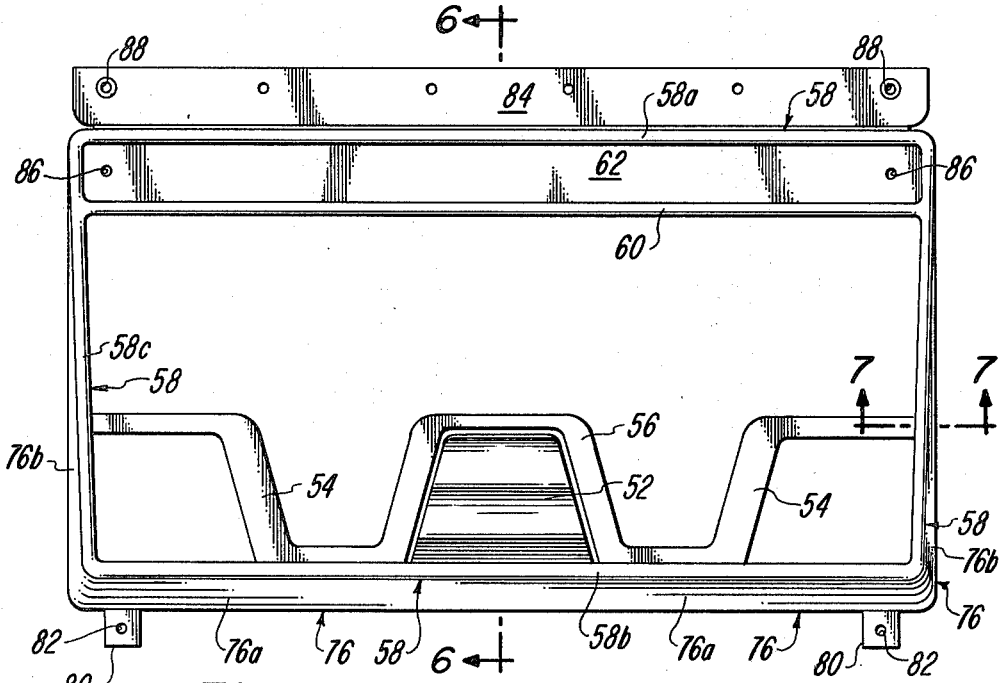
FIG. 5 is a front elevational view of the front portfolio frame shown in FIG. 4.
Figure 6:
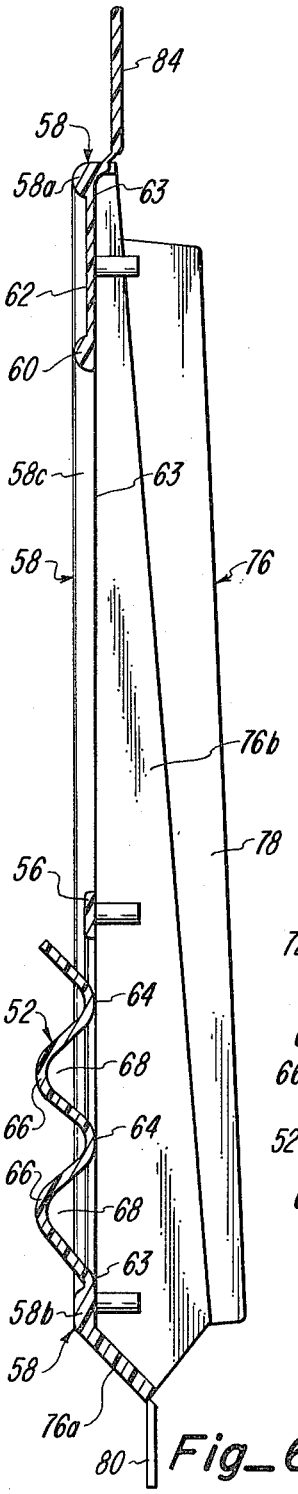
FIG. 6 is a vertical section view substantially in the plane of line 6—6 of FIG. 5.

The peripheral margin structure of the portfolio frame 40 is of generally right rectangular configuration in a front viewing perspective, as is shown best in FIGS. 2, 3 and 5. The peripheral margin structure of the frame 40 includes an outer peripheral bead 58 having a horizontally-oriented top portion 58*a*, a horizontally-oriented bottom portion 58*b* and two vertically extending and horizontally spaced parallel side portions 58*c*. The peripheral bead 58 creates strength and rigidity in the portfolio frame. The peripheral bead 58 lies substantially in a single plane, as is shown in FIG. 6. A rib bead 60 extends horizontally between the side bead portions 58*c* at a distance closely inwardly spaced from the upper bead portion 58*a*. A web 62 of material extends between rib bead 60 and the upper bead portion 58*a*. The web 62 presents a header-like panel to which the fastener studs 38 (FIGS. 1 to 3) are attached to project forward therefrom. The center area opening 46 is thus defined by the space enclosed by the bead portions 58*b* and 58*c* and the rib bead 60. The flat rear surfaces 63 of the peripheral bead 58, the rib bead 60, and the web 62 fall in a common plane, and the backing panel 42 contacts these rear surfaces 63 (FIGS. 10 and 11).

The article retention clip 52 extends integrally from a center location of the peripheral bead portion 58*b* in a cantilever manner into the center area opening 46. The clip 52 is generally of undulated cross section, as is best shown in FIG. 6. The rearwardmost curves 64 of the clip 52 fall adjacent the plane defined by the rear surfaces 63 of the peripheral bead 58, the rib bead 60 and the web 62, when the clip 52 occupies its normal position. Consequently, the rearwardmost curves 64 contact or are very narrowly spaced from the backing panel in the normal position. Similarly, the rear surface of the U-shaped border 56 also falls within this same plane defined by surfaces 63. The forwardmost curves 66 of the undulating clip 52 extend forward of the front surface of the U-shaped border 56. The spaces 68 to the rear of the forwardmost curves 66 and in front of the U-shaped border 56 define grooves which are approximately horizontally parallel and are used for the purpose of retaining pencils, pens 70, or the like, between the undulating clip 52 and the front surface of the U-shaped border 56, as is shown in FIG. 10. The clip 52 is an integral part of the portfolio frame 40. The material from which the portfolio frame 40 and clip 52 are formed has resiliency characteristics which allow the clip to angularly deflect forward from the plane which it normally occupies, shown in FIG. 6, to the forward deflected position shown in FIG. 10. In the forward deflected position, the rearward curves 64 lie in front of the plane defined by the rear surfaces 63. When forwardly deflectd, the resiliency of the clip material applies a retention force to hold the pen between the clip 52 and the U-shaped border 56. The bead portion 58*b* secures sufficient strength against which the clip 52 can deflect and obtain retention force sufficient to retain articles.

Figure 10:
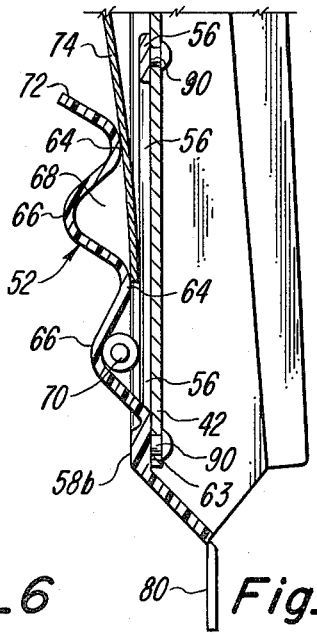
FIG. 10 is a section view taken substantially in the plane of line 10—10 of FIG. 3 and further illustrating the retention of articles such as a pen and an envelope by an article retention clip means integral with the portfolio frame.
Figure 11:
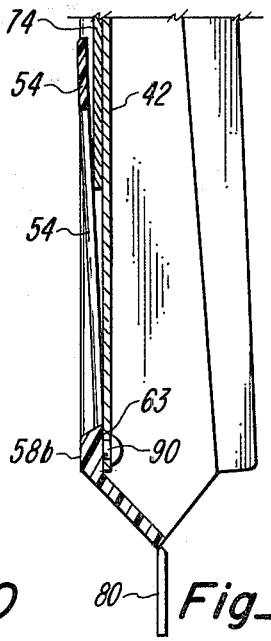
FIG. 11 is a partial section view taken substantially in the plane of line 11—11 of FIG. 3 and further illustrating the retention of articles such as an envelope by an article retention bracket means integral with the portfolio frame.

An inner edge 72 of the retention clip 52 extends forward from the plane of the rear surfaces 63 and in front of the front surface of the U-shaped border 56, as is shown in FIGS. 6 and 10. The inner edge 72 allows flat articles 74 (FIG. 10) to be quickly and conveniently inserted between the rear curves 64 of the clip 52 and the backing panel 42. The flat articles 74 may be business cards, papers, envelopes, or the like. Each of the articles is retained by the resiliency of the clip 52 against the backing panel 42 in cooperation with the U-shaped border 56. For flat articles, the U-shaped border 56 may not provide a sufficient backing area to support the flat articles, in which case the backing panel 42 provides a sufficient area.

Figure 7:
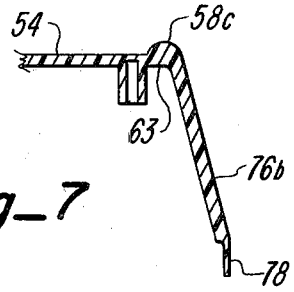
FIG. 7 is a horizontal view substantially in the plane of line 7—7 of FIG. 5.

Each L-shaped corner retention bracket 54 extends integrally from one side bead portion 58*c* and the bottom bead portion 58*b* into the center area opening 46 at the corners where the bead portions 58*b* and 58*c* intersect. The outer ends of the leg portions of the L-shaped brackets 54 are connected to these bead portions. Thus, the L-shaped brackets 54 are also cantileverly connected from the peripheral bead 58. In their normal position, the rear surfaces of both brackets lie in the plane defined by the rear surfaces 63 (FIG. 7). In the deflected position, shown in FIG. 11, the resiliency of the material of the brakets 54 creates a retention force against flat articles 74 positioned between the rear surface of the brackets 54 and the front surface of the backing panel 42. This force retains the flat articles 74 to the portfolio.

A skirt-like border 76 extends rearward from the peripheral bead portions 58*b* and 58*c*, as is shown best in FIGS. 5 to 7. The skirt-like border 76 is defined by a bottom skirt portion 76*a* which diverges downwardly and rearwardly from the lower bead portion 58*b*, and two side skirt portions 76*b* which diverge outwardly and rearwardly from the side bead portions 58*c*. The bottom skirt portion 76*a* is primarily useful for defining a bottom end wall for the file pockets 32 (FIGS. 1 and 2) of the pocket structure 44 of the portfolio. The side skirt portions 76*b* enclose the side marginal areas of the pocket structure 44 (FIGS. 1 and 3) within the portfolio 20 when the portfolio is closed within the interior of the upper case half 22 (FIG. 1).

A strip 78 along each rearward edge of each side skirt portion 76*b* is of reduced thickness, as is shown primarily in FIG. 7. The strip 78 extends vertically along the full length of each side skirt portion 76*b*, as is shown in FIG. 6. The reduced thickness of the strip 78 allows the forward edge of each gusset 50 (FIG. 2) to be sewn to each side skirt portion 76*b* along the strip 78.

A pair of horizontally spaced tabs 80 extend integrally from the lower edge of the bottom skirt portion 76*a* of the portfolio frame 40, as is shown best in FIGS. 5 and 6. The tabs 80 have holes 82 (FIGS. 2 and 3) formed therein and are used to pivotably attach the portfolio frame 40 to an inner surface of the upper attache case half 22 (FIG. 1). A narrow strip of frame material separates the tabs 80 and the bottom skirt portion 76*a* and functions as a living hinge during the pivoting movement of the portfolio from the interior of the upper attache case half.

Figure 8:
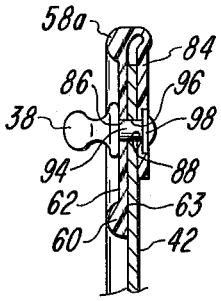
FIG. 8 is a partial section view taken substantially in the plane of line 8—8 of FIG. 3.

An integral flap 84 extends from the upper peripheral bead portion 58*a* of the portfolio frame 40, as is shown in FIGS. 5 and 6. The frame material separating the flap 84 and the upper bead portion 58*a* functions as a living hinge to allow the upper flap 84 to fold down behind the backing panel 42 when the panel 42 is assembled to the portfolio frame 40, as is shown in FIG. 8. Holes 86 and 88 are respectively formed in the web 62 and flap 84 in positions which result in alignment of the holes 86 and 88 when the rear flap 84 is folded down into the position shown in FIG. 8.

Figure 4:
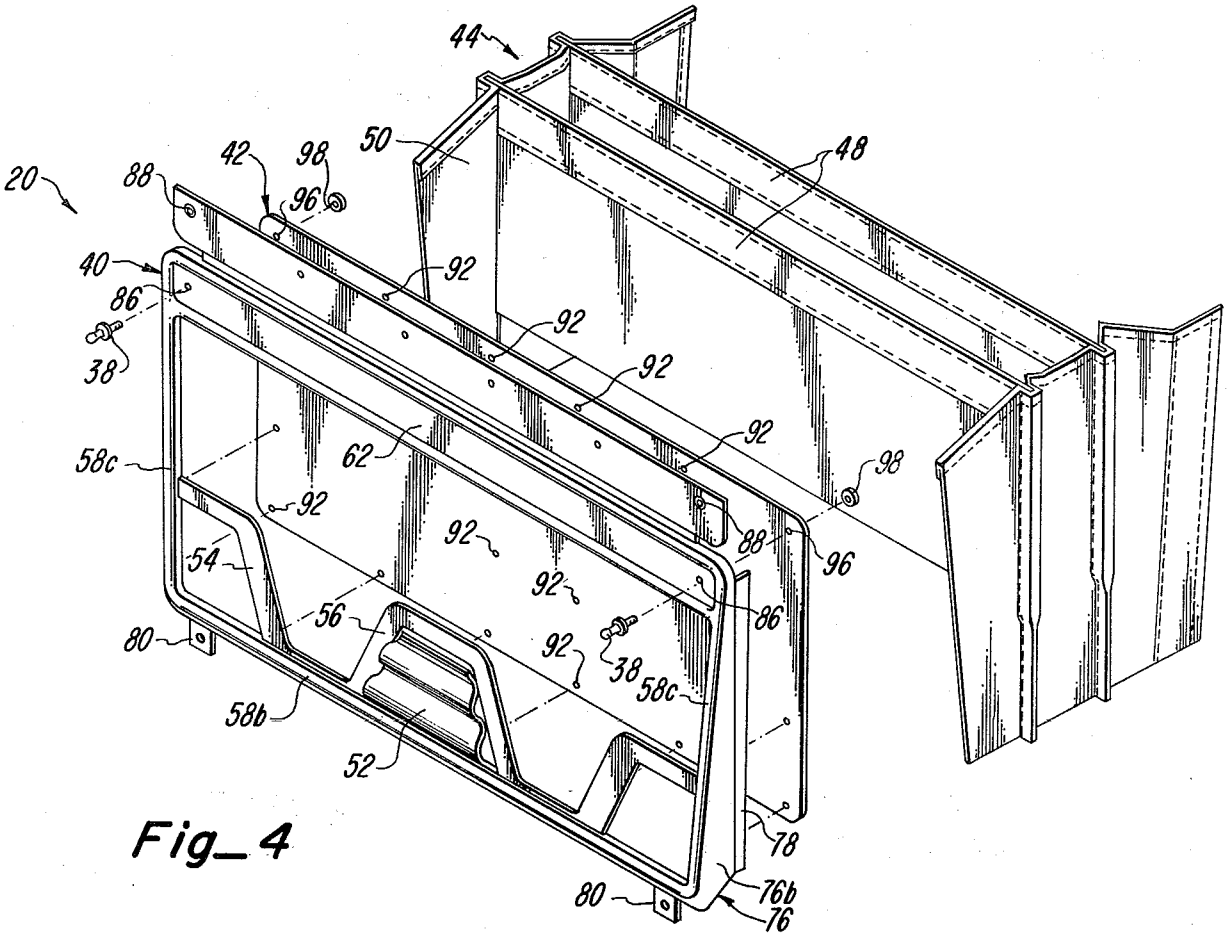
FIG. 4 is an exploded perspective view of a front portfolio frame, a backing panel, and a rear pocket structure of the portfolio shown in FIG. 2.

A plurality of integral attachment projections 90 are provided on the portfolio frame 40 for the purpose of attaching the backing panel to the portfolio frame, as is shown in FIGS. 6, 7 and 9 to 11. The attachment projections 90 extend rearward of the plane defined by the rear surfaces 63. Each of the projections 90 aligns with a correspondingly-shaped opening 92 formed in the backing panel 42, as is shown in FIG. 4. It should be noted that at least one projection member 90 extends from the U-shaped border 56 for the purpose of attaching the U-shaped border to the backing panel 42 (FIG. 6). No projection members 90 extend rearward from the article retaining clip 52 or brackets 54, thereby allowing the clip and brackets 54 to resiliently deflect away from the backing panel 42 to retain articles therebetween. These features are illustrated in FIGS. 10 and 11.

Figure 9:
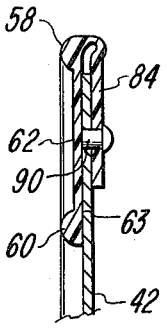
FIG. 9 is a partial section view taken substantially in the plane of line 9—9 of FIG. 3.

The backing panel 42 is attached to the portfolio frame preferably by ultrasonically welding or deforming the rearward portion of each projection 92 into an expanded head over the rear surface of the panel 42 surrounding the holes 92, as is shown in FIGS. 9, 10 and 11. Other types of attachment means could be utilized. However, ultrasonically deforming or welding the ends of the projection members 90 is relatively inexpensive and is rapidly accomplished during manufacturing of the portfolio.

The assembly and manufacturing of the portfolio 20 is generally summarized by reference to FIG. 4. The backing panel 42 is contacted with the rear planar surfaces 63 of the portfolio frame 40 with the holes 92 in the panel 42 receiving therein the attachment projections 90 (not shown in FIG. 4). The panel 42 is held tightly against the rear surface of the portfolio frame and those attachment projections 92 which extend from the bottom and side bead portions 58*b* and 58*c* and from the U-shaped border 56 are deformed to hold the backing panel 42 in place, as is shown in FIGS. 10 and 11. The flap 84 is folded over the top edge of the backing panel 42 and the attachment projections extending rearwardly from the web 62 are deformed over the exterior rearward facing surface of the folded flap 84, as is shown in FIG. 9. The studs 38 are next attached, as is shown in FIG. 8. Each stud 38 is made of metallic material and includes a rearward extending shank 94. The shank 94 extends through the aligned openings 86 and 88 in the web 62 and rear flap 84, respectively, and additionally through an aligned hole 96 formed in the backing panel 42. A washer 98 is placed over the rearward end of the shank 94 and the rearward end is deformed or upset over the washer, in much the same manner as a rivet is formed. The attached studs 38 serve to further retain the flap 84 in the downward folded position and to retain the backing panel 42 between the web 62 and the rear flap 84.

By retaining the backing panel 42 to the portfolio frame 40 in the manner described, the backing panel 42 contributes to the strength of the front pannel assembly of the portfolio defined by the portfolio frame and backing panel. The top flap 84 forms a smoothly curved surface over the top edge of the front panel assembly for smooth access into the file pocket between the front panel assembly and the next rearwardly adjoining divider 48.

After the portfolio frame 40 and backing panel 42 have been assembled, the pocket structure 44 is next connected to the portfolio 20. The front edge of the gussets 50 on each side of the pocket structure are sewn to the reduced thickness strip 78 extending along the rearward edge of each side skirt portion **76*b*. The sewing seam connecting the gussets 50 to the side skirt portions 76*b* is referenced 100 in FIG. 2. Of course, the pocket structure 44 is completely constructed before sewing it to the portfolio frame 40**.

After the portfolio 20 has been completely assembled as has been described, the portfolio 20 is attached to the interior of the upper half of the attache case. The attachment tabs 80 and their associated holes 82 are used in connecting the lower marginal edge of the portfolio frame adjoining the rear back edge 28 of the upper case half 22 (FIG. 1). The attachment tabs 80 can be attached in a conventional known manner to the attache case half. The rear edges of the gussets 50 are likewise attached along the interior sides of the upper attache case half 22 (FIG. 1) between the back edge 28 and front edge 30.

It can now be appreciated that an advantageous and improved portfolio is available as a result of the present invention. The portfolio utilizes an inexpensive, molded and preferably plastic frame to which a relatively inexpensive and attractive backing panel is easily and inexpensively connected. The time and materials required to construct the front panel assembly is substantially reduced, as compared to the time and materials involved in sewing and assembling a prior conventional front panel. Furthermore, the ability to retain and hold articles in convenient locations on the front of the portfolio is maintained and improved by use of the article retaining means in the form of the retention clip and retention brackets. The undulations in the retention clip position pencils, pens, and the like, in a more accessible location than if the pencils were dropped into the typical pockets in prior conventional portfolios. The skirt-like border portions allow the pocket structure of the portfolio to be quickly and conveniently sewn to the portfolio frame. Many other advantages and improvements result from the present invention.

A preferred embodiment of the present invention has been shown and described with a degree of particularity. It should be understood, however, that changes in details may be made without departing from the scope of the invention defined by the appended claims.

What is claimed is:

1. A portfolio comprising:

portfolio frame having a peripheral margin structure defining an interior opening through the portfolio frame;

a backing panel extending over the interior opening and operatively connected to the portfolio frame to substantially resist forces applied thereto; and article retaining means operatively connected to the peripheral margin structure and extending into the interior opening adjacent the backing panel, said article retaining means resiliently deflectable to a deflected position spaced away from the backing panel and operatively developing retaining force through the operative connection to the portfolio frame for retaining articles in the space between the backing panel and the deflected article retaining means.

2. A portfolio as defined in claim 1 wherein said article deflecting means is integrally a part of the portfolio frame.

3. A portfolio comprising:

a portfolio frame having a peripheral margin structure defining an interior opening through the portfolio frame;

a backing panel connected to the portfolio frame and extending over the interior opening; and article retaining means connected to the peripheral margin structure and extending into the interior opening adjacent the backing panel, said article retaining means resiliently deflectable to a deflected position spaced away from the backing panel to develop a retaining force for retaining articles in the space between the backing panel and the deflected article retaining means, said article retaining means is integrally part of the portfolio frame, and said portfolio frame and said article retaining means are formed from molded plastic material.

4. A portfolio comprising:

a portfolio frame having a peripheral margin structure defining an interior opening through the portfolio frame;

a backing panel connected to the portfolio frame and extending over the interior opening; and article retaining means connected to the peripheral margin structure and extending into the interior opening adjacent the backing panel, said article retaining means resiliently deflectable to a deflected position spaced away from the backing panel to develop a retaining force for retaining articles in the space between the backing panel and the deflected article retaining means, said article retaining means is integrally part of the portfolio frame, and said article retaining means comprises a clip cantileverly extending from the peripheral margin structure into the interior opening.

5. A portfolio as defined in claim 4 wherein said clip includes means defining grooves extending across the clip and between the clip and the backing panel, the grooves adapted for holding pens, pencils, or similarly shaped articles.

6. A portfolio as defined in claim 5 further including a U-shaped border portion extending from the peripheral margin structure into the open interior area and surrounding the clip.

7. A portfolio as defined in claim 6 wherein the U-shaped border includes means for attaching the U-shaped border to the backing panel.

8. A portfolio as defined in claim 4 wherein said article retaining means comprises a bracket structure extending into the interior opening and extending between two separated points on the peripheral margin structure.

9. A portfolio as defined in claim 8 wherein the peripherl margin structure defines at least one corner at the interior opening, and the bracket structure extends across the corner.

10. A portfolio as defined in claim 9 wherein the bracket structure is generally L-shaped.

11. A portfolio comprising:

a portfolio frame having a peripheral margin structure defining an interior opening through the portfolio frame, the peripheral margin structure including a rearward extending skirt-like border having opposite side skirt portions extending generally vertically along horizontally opposite vertically extending edges of the frame; and a backing panel connected to the portfolio frame and extending over the interior opening; and article retaining means connected to the peripheral margin structure and extending into the interior opening adjacent the backing panel, said article retaining means resiliently deflectable to a deflected position spaced away from the backing panel to develop a retaining force for retaining articles in the space between the backing panel and the deflected article retaining means.

12. A portfolio as defined in claim 11 further comprising a file pocket structure having flexible side gussets, and wherein the gussets of the file pocket structure are attached to the side skirt portions of the skirt-like border.

13. a portfolio as defined in claim 12 wherein the side gussets are sewn to the side skirt portions.

14. A portfolio as defined in claim 8 wherein said peripheral margin structure includes an upper header-like panel and fasterner means connected to the header-like panel.

15. A portfolio as defined in claim 8 wherein the portfolio frame includes a top flap extending from the peripheral margin structure and folded down behind the backing panel.

16. A portfolio comprising:

a portfolio frame having a peripheral margin structure defining an interior opening through the portfolio frame;

a backing panel connected to the portfolio frame and extendding over the interior opening; and article retaining means connected to the peripheral margin structure and extending into the interior opening adjacent the backing panel, said article retaining means resiliently deflectable to a deflected position spaced away from the backing panel to develop a retaining force for retaining articles in the space between the backing panel and the deflected article retaining means;

the peripheral margin structure including a peripheral bead having a bottom horizontally extending portion and two horizontally spaced and vertically extending side portions extending from the bottom portion;

said article retaining means comprising a clip cantileverly extending from a center location of the bottom bead portion and a pair of L-shaped corner brackets extending from the bottom bead portion to each side bead portion in the corner area where each side bead portion intersects the bottom bead portion;

said portfolio frame further including a generally U-shaped border extending from the bottom bead portion and surrounding the clip, the U-shaped border portion attaching to the backing panel;

the peripheral margin structure further including a skirt-like border having a bottom skirt portion extending rearwardly from the bottom bead portion and a pair of side skirt portions extending rearwardly from the side bead portions;

said portfolio further comprising a file pocket structure comprising dividers and gussets attached to the horizontally opposite sides of the dividers; and the gussets are attached to the side skirt portions by means including sewing.

17. A portfolio for an attache case comprising:

a portfolio frame having a peripheral margin structure defining an interior opening through the portfolio frame, a backing panel connected to the portfolio frame and extending over and covering the interior opening, and a clip cantileverly integrally connected to the peripheral margin structure and extending into the interior opening adjacent the backing panel, said clip including means defining a plurality of grooves between the clip and the backing panel, the grooves adapted for holding pencils and the like between the clip and the backing panel.

18. A portfolio as defined in claim 17 further comprising a U-shaped border integrally connected to and extending from the peripheral margin structure and surrounding the clip in the interior opening, the U-shaped border attached to the backing panel.

19. A portfolio as defined in claims 17 or 18 wherein the clip is of undulating shape.

20. A method of fabricating a portfolio for an attache case or the like, comprising:

forming a portfolio frame from plastic material having semirigid, resilient, and somewhat flexible characteristics, the portfolio frame having a peripheral margin structure defining an interior opening therethrough and article retaining means extending from the peripheral margin structure into the interior opening;

attaching a backing panel to the portfolio frame, the backing panel extending substantially over the open interior area; and attaching a file pocket structure to the portfolio frame.

21. A method as defined in claim 20 wherein forming the portfolio frame comprises molding the frame as a single integral structural element.

22. A method as defined in claim 21 wherein:

the portfolio frame further includes a skirt-like border extending rearwardly from the peripheral margin structure, and further comprising:

attaching a file pocket structure to the portfolio frame by sewing flexible side gussets of the pocket structure to the skirt-like border.

23. A method as defined in claim 21 wherein:

the portfolio frame includes at least one rearward extending attachment projection, and the backing panel includes at least one attachment hole, and the backing panel is attached to the portfolio frame by inserting the attachment projection into the attachment hole and ultrasonically deforming a portion of the attachment projection over the backing panel at the attachment hole.

24. A method as defined in claim 21 wherein the the portfolio frame includes a clip which, in a normal position thereof, lies against the backing panel after assembly of the backing panel onto the portfolio frame and which, in a deflected position thereof, is deflected away from the backing panel and develops a restraining force for retaining articles in the space between the backing panel and the deflected clip.

25. A method as defined in claim 20 wherein the interior opening defines at least one corner and the portfolio frame includes a generally L-shaped bracket which, in a normal position thereof, lies against the backing panel after assembly of the backing panel onto the portfolio frame and which, in a deflected postion thereof, is deflected away from the backing panel and develops a restraining force for retaining articles in the space between the backing panel and the deflected L-shaped bracket.

26. A portfolio comprising:

a portfolio frame having a peripheral margin structure defining an interior opening through the portfolio frame;

a backing panel connected to the portfolio frame and extending over the interior opening; and article retaining means connected to the peripheral margin structure and extending into the interior opening adjacent the backing panel, said article retaining means resiliently deflectable to a deflected position spaced away from the backing panel to develop a retaining force for retaining articles in the space between the backing panel and the deflected article retaining means, said article retaining means further comprising a bracket structure extending into the interior opening and extending between separated points on the peripheral margin structure.

27. A portfolio as defined in claim 25 wherein the peripheral margin structure defines at least one corner at the interior opening, and the bracket structure extends across the corner.

28. A portfolio as defined in claim 27 wherein the bracket structure is generally L-shaped.

29. A portfolio as defined in claim 26 wherein said peripheral margin structure includes an upper header-like panel and fastener means conneced to the header-like panel.

30. A portfolio as defined in claim 26 wherein the portfolio frame includes a top flap extending from the peripheral margin structure and folded down behind the backing panel.

31. A portfolio as defined in claim 4 wherein said clip operatively develops restraining force from angular deflection of the clip from a position adjacent the backing panel to the deflected position.

* * * * *